US005713379A

United States Patent [19]

Collins et al.

[11] Patent Number: 5,713,379

[45] Date of Patent: Feb. 3, 1998

[54] CURLING IRON SYSTEM WITH A FRICTION ELEMENT TO GENERATE HEAT

[76] Inventors: Joyce E. Collins, 7071 Melanie Dr.; Ethel Evans, 2485 W. Belmont St., both of Pensacola, Fla. 32505

[21] Appl. No.: 719,363

[22] Filed: Sep. 25, 1996

[51] Int. Cl.[6] ..... A45D 1/02

[52] U.S. Cl. ..... 132/227; 126/247

[58] Field of Search ..... 132/226, 227, 132/233, 234, 271, 229, 237, 269; 126/247

[56] References Cited

U.S. PATENT DOCUMENTS

| | | | |
|---|---|---|---|
| 3,250,895 | 5/1966 | McNair | 132/229 |
| 3,892,943 | 7/1975 | Van Droogenbroek . | |
| 4,101,756 | 7/1978 | Yamano . | |
| 4,524,755 | 6/1985 | Harris et al. | 126/247 |
| 4,591,695 | 5/1986 | Inoue . | |
| 4,803,341 | 2/1989 | Barowski . | |
| 5,117,090 | 5/1992 | Askins | 132/233 |

*Primary Examiner*—Todd E. Manahan
*Assistant Examiner*—E. Robert
*Attorney, Agent, or Firm*—Joseph N. Breaux

[57] ABSTRACT

A curling iron system includes a curling iron device having a handle and a tubular curling rod attached to the handle. The tubular curling rod has a tubular curling iron cavity defined by a substantially cylindrical shaped sidewall within the tubular curling rod. The curling iron system further has a curling rod rotor assembly which includes a rotor shaft having a friction element secured along a section thereof positioned within the curling iron cavity, and a drive motor engagement mechanism secured to an end of the rotor shaft positioned exteriorly of the curling iron cavity that is detachably connectable to a source of rotation energy.

20 Claims, 2 Drawing Sheets

CURLING IRON SYSTEM WITH A FRICTION ELEMENT TO GENERATE HEAT

TECHNICAL FIELD

The present invention relates to curling irons used to curl hair and more particularly to a curling iron system that uses friction generated between a friction element and the inside of a tubular curling iron rod to provided the heat required to heat the exterior of the tubular curling rod to a temperature sufficient to curl the hair of a user.

BACKGROUND OF THE INVENTION

Curling rods provide a convenient way to curl hair. Curling irons typically utilize an electric heating element housed within a tubular curling rod to provided the heat to the curling rod. Although these curling irons work well, they are subject to malfunctions that result in the curling rod being heated to temperatures that can seriously damage the hair of a user. It would be a benefit, therefore, to hair a curling iron system that would not achieve excessive temperatures.

In addition, curling irons with electric heating elements often require constant power. The power cord necessitated by this requirement can interfere with use of the curling iron and pose a danger of electrical shock to the user. It would be a benefit, therefore, to have a curling iron that did not require a power cord, and that did not pose a threat of electrical shock to a user when in use. Because, the curling iron must be lifted above the shoulders and head of the user, it would also be a benefit to have a lightweight curling iron.

SUMMARY OF THE INVENTION

It is thus an object of the invention to provide a curling iron system that does not achieve excessive temperatures.

It is a further object of the invention to provide a curling iron system that does not require a power cord to be attached to the curling iron when in use.

It is a still further object of the invention to provided a curling iron system that does not pose a threat of electrical shock to a user when in use.

It is a still further object of the invention to provide a curling iron system that is lightweight.

It is a still further object of the invention to provide a curling iron system that accomplishes all or some of the above objects in combination.

Accordingly, a curling iron system is provided. The curling iron system comprises a curling iron device having a handle; a tubular curling rod, attached to the handle, having a tubular curling iron cavity defined by a substantially cylindrical shaped sidewall within the tubular curling rod; and a curling rod rotor assembly including a rotor shaft, having a friction element secured along a section thereof positioned within the curling iron cavity, and a drive motor engagement mechanism secured to an end of the rotor shaft positioned exteriorly of the curling iron cavity that is detachably connectable to a source of rotational energy, the friction element being sized sufficiently to contact the substantially cylindrical shaped sidewall defining the tubular curling iron cavity within the tubular curling rod and generate frictional heat when rotated within the tubular cavity by a force acting against and rotating the drive motor engagement mechanism. In use, the drive motor engagement mechanism is coupled to a drive motor and the curling iron rotor shaft and friction element rotate within the tubular curling iron cavity for a period of time sufficient to cause frictional heat to be built up within the curling iron rod. The user then uses the curling iron to curl his/her hair in the conventional manner after disengaging the drive motor engagement mechanism from the drive motor. In addition, use of a frictional heat generating mechanism driven by an detachable power source eliminates the need for a power cord and the possibility of electrical shock when curling hair.

In a preferred embodiment the handle of the curling iron device has a passageway formed therethrough, the tubular curling rod is attached to the handle in a manner such that the tubular curling iron cavity within the tubular curling rod is in communication with the passageway formed through the handle, and a portion of the curling iron rotor shaft is rotatably positioned through the passageway in a manner such that the drive motor engagement mechanism is positioned at the base of the handle.

In another preferred embodiment the curling iron system further includes a power base having a housing; at least one electrical motor positioned within the housing and provided with a curling iron engagement mechanism adapted for detachable connection with the drive motor engagement mechanism of the curling iron; and at least one holding mechanism that is adapted to hold one curling iron while the curling iron engagement mechanism and the drive motor engagement mechanism are engaged and the electrical motor is rotating. The holding mechanism is preferably a holding cavity formed within the power base that has the curling iron engagement mechanism positioned therein. When this embodiment I used the holding cavity is sized to frictionally engage and hold at least a portion of the handle when the handle is inserted therein.

Although the drive motor engagement mechanism and the curling iron engagement mechanism can be any complimentary mechanism that allows the electrical motor to be detachably coupled to the curling rod rotor shaft, use of complimentary gears is preferred. In addition, when a power base is provided, it is preferred to provided each electrical motor with a timer to allow the user to preset a desired run time for frictional heat to build within the curling rod.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
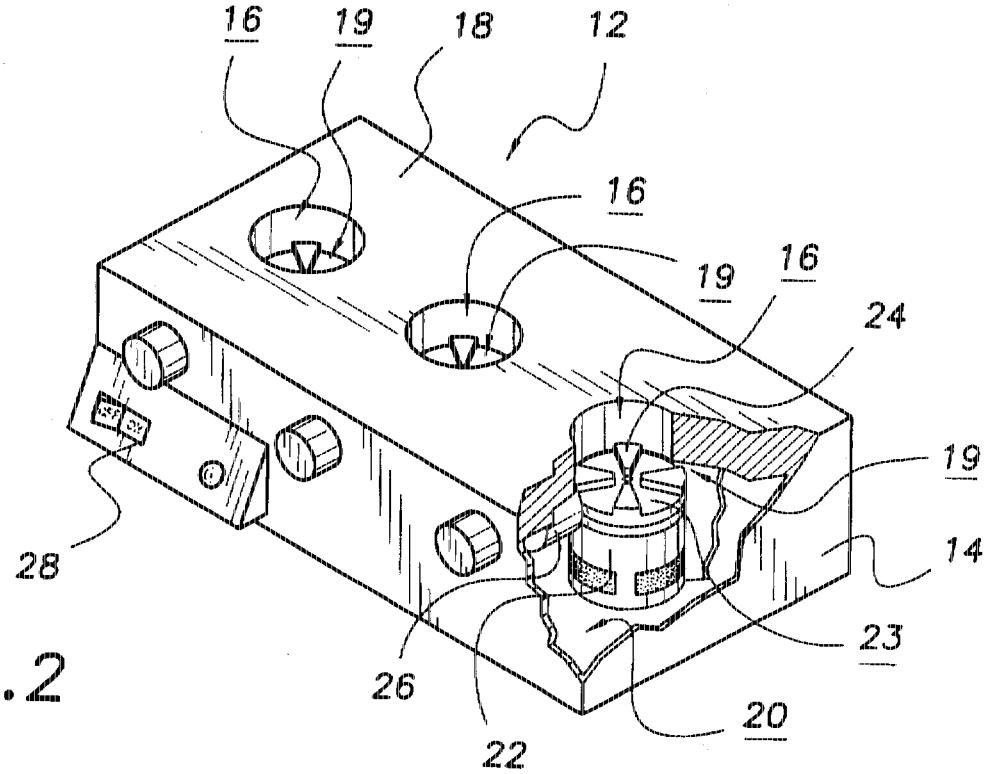
FIG. 1 is a perspective view of an exemplary embodiment of the power base of the curling iron system of the present invention showing the housing containing three timed motors each with a nylon engagement member, the holding cavities formed through the upper surface of the housing, the master on/off switch, and the three timer mechanisms.
Figure 2:
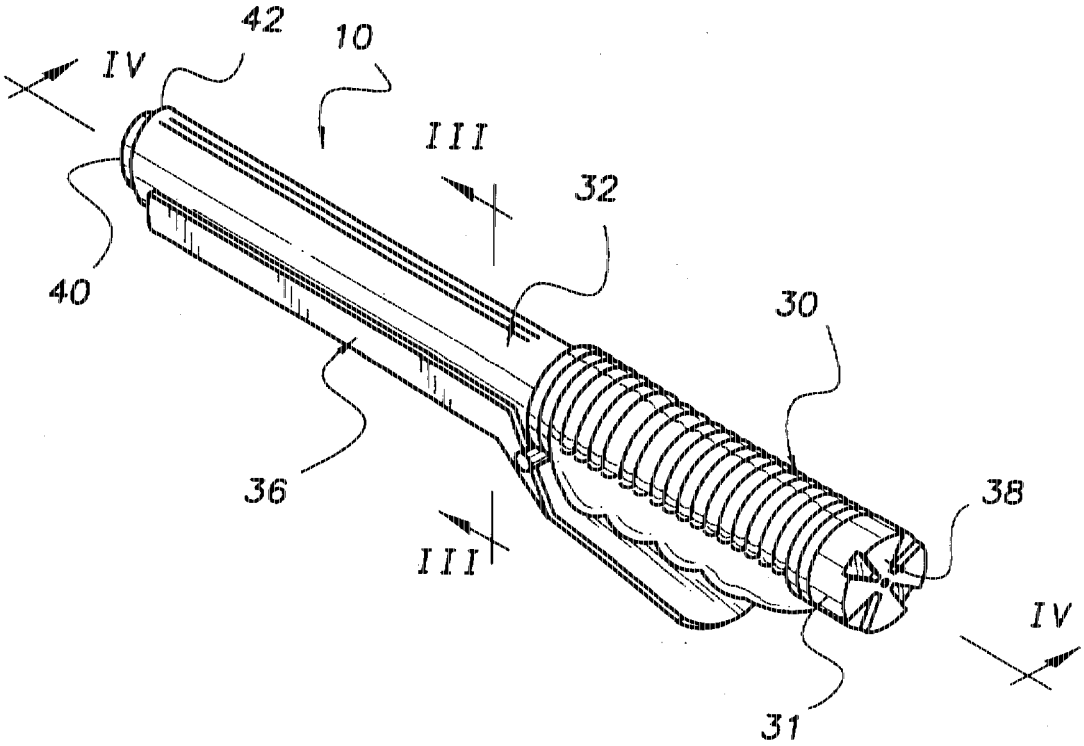
FIG. 2 is a perspective view of one of the curling iron devices of the present invention showing the handle, the hair clamp, the tubular curling rod, and the motor engagement gear of the curling rod rotor assembly.

The exemplary curling iron system comprises a curling iron device, generally designated by the numeral 10 in FIG. 2, and a power base that supplies power to curling iron device 10, generally designated by the numeral 12 in FIG. 1. In this embodiment, power base 10 includes a plastic housing 14 having three identical curling iron holding cavities 16 formed into an upper surface 18 thereof. Holding cavities 16 include an engagement aperture 19 that is in communication with an interior compartment 20.

Three conventional electrical motors 22 are positioned within interior compartment 20. Each electrical motor 22 is provided with a curling iron engagement member 23 having four engagement projections 24 extending from a side surface thereof. Each electrical motor 22 is positioned beneath an engagement aperture 19 in a manner such that a curling iron engagement member 23 is also positioned beneath an engagement aperture 19. A conventional timer mechanism 26 is provided for each motor 22 to allow a user to selected a desired run time for each motor 22. A master power control switch 28 is also provided to control power availability to all three motors 22. When control switch 28 is in the "off" position electrical power is disconnected from all three motors 22. When control switch 28 is in the "on" position, electrical power is available to each motor 22 through activation of its respective timer mechanism 26.

Figure 5:
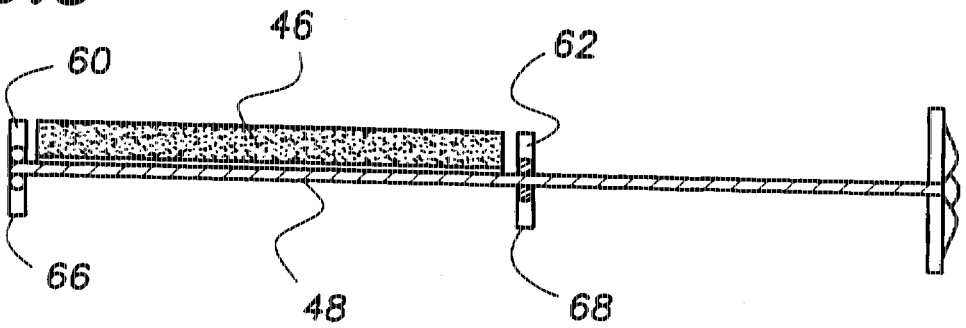
FIG. 5 is a sectional detail view of the full curling rod rotor assembly in isolation showing the rotor, the motor engagement gear, the friction element and two bearing assemblies.

With reference to FIG. 2, curling iron device 10 includes a handle, generally designated 30; a tubular curling rod, generally designated 32; a hair clamp, generally designated 36; and a curling rod rotor assembly, generally designated 38 (shown in isolation in FIG. 5). Handle 30 includes a base 31 sized to snugly fit within a holding cavity 16 of power base 12.

Figure 3:
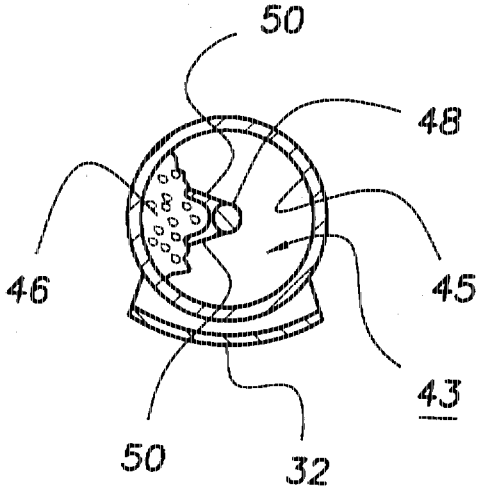
FIG. 3 is a section view of the curling iron of FIG. 2 along the line III—III showing the tubular curling rod cavity, the rotor and friction element of the curling rod rotor assembly, and the hair clamp.

Tubular curling rod 32 is constructed from a length of polished stainless steel tubing having an endcap 40 secured at the far end 42 thereof. With reference to FIG. 3, tubular curling rod 32 has a cylinder shaped curling iron cavity 43 formed therein and defined along the length thereof by a smooth interior sidewall 45. In use a friction element 46 contacts interior sidewall 45 while spinning within curling iron cavity 43 generating heat used to warm tubular curling iron 32. Friction element 46 is constructed from heat resistant synthetic felt and is a component of curling iron rotor assembly 38. Friction element 46 is secured to a rotor shaft 48 by a pair of clips 50.

Figure 4:
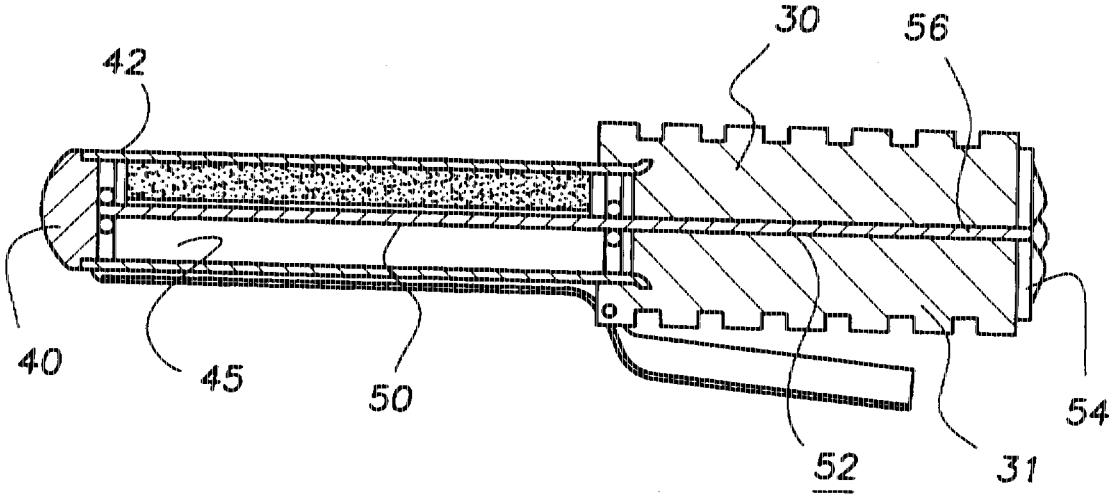
FIG. 4 is a sectional view of the curling iron of FIG. 2 along the line IV—IV showing the curling rod endcap, the tubular curling rod, the tubular curling rod cavity, the handle, the hair clamp, and the full curling rod rotor assembly including the rotor, the motor engagement gear, the friction element and two bearing assemblies.

With reference to FIG. 4, rotor shaft 48 is constructed from stainless steel and extends through a passageway 52 formed through handle 30. A nylon drive motor engagement gear 54 is secured to a first end 56 of rotor shaft 48 that extends out through passageway 52 to the exterior of handle 30. Drive motor engagement gear 54 complimentarily engages a respective curling iron engagement member 23 of an electric motor 22 when base 31 of handle 30 is inserted into one of the holding cavities 16.

With reference to FIG. 5, a first bearing assembly 60 is provided at a second end of rotor shaft 48 and a second bearing assembly 62 is provided on rotor shaft 48 at a location on rotor shaft 48 past the location of friction member 46. The outer edges 66,68, respectively, are sized to contact interior sidewall 45 of curling iron cavity 43 and keep rotor shaft 48 rotating in the center of curling iron cavity 43.

Use of the exemplary curling iron system of the present invention is simple. Base 31 of handle 30 is inserted into a holding cavity 16 until drive motor engagement gear 54 engages a curling iron engagement member 23. After verifying that master power switch 28 is in the "on" position, timer mechanism 26 is set for the desired period of run time. Motor 22 is then allowed to run for the set time period. As motor 22 runs, heat is generated within tubular curling rod 32 from frictional contact between friction member 46 and interior sidewall 45. Once the period set on timer mechanism 28 has elapsed, motor 22 ceases rotation. Curling iron device 10 is then disengaged from power base 12 by grasping handle 30 and pulling base 31 free from holding cavity 16. Once base 31 is free, curling iron device 10 is used as any conventional curling iron. Tubular curling rod 32 can be heated over and over, by simply repeating the previous steps.

It can be seen from the preceding description that a curling iron system has been provided that does not achieve excessive temperatures; that does not require a power cord to be attached to the curling iron when curling hair therewith; that does not pose a threat of electrical shock to a user when in use; and that is lightweight.

It is noted that the embodiment of the curling iron system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A curling iron system comprising:

a curling iron device having;

a handle;

a tubular curling rod, attached to said handle, having a tubular curling iron cavity defined by a substantially cylindrical shaped sidewall within said tubular curling rod; and a curling rod rotor assembly including a rotor shaft, a friction element that is secured along a section of said rotor shaft and positioned within said curling iron cavity, and a drive motor engagement mechanism secured to an end of said rotor shaft and positioned exteriorly of said curling iron cavity;

said drive motor engagement mechanism being detachably connectable to a source of rotational energy;

said friction element being sized sufficiently to contact said substantially cylindrical shaped sidewall defining said tubular curling iron cavity within said tubular curling rod and generate frictional heat when rotated within said tubular cavity by a force acting against and rotating said drive motor engagement mechanism.

2. The curling iron system of claim 1, wherein:

said handle has a passageway formed therethrough;

said tubular curling rod is attached to said handle in a manner such that said tubular curling iron cavity is in communication with said passageway formed through said handle; and a portion of said curling iron rotor shaft is rotatably positioned through said passageway in a manner such that said drive motor engagement mechanism is positioned at a base end of said handle.

3. The curling iron system of claim 2, further including:

a power base having a housing, at least one electrical motor, positioned within said housing, and a holding mechanism that is adapted to hold said curling iron device in a manner such that said tubular curling rod is prevented from rotating when said drive motor engagement mechanism is engaged with said electrical motor and said electrical motor is in operation.

4. The curling iron system of claim 3 wherein:

said electrical motor includes a curling iron engagement mechanism adapted for detachable connection with said drive motor engagement mechanism of said curling iron device.

5. The curling iron system of claim 4, wherein:

said drive motor engagement mechanism is a first gear; and said curling iron engagement mechanism is a second gear that is meshable with said first gear in a manner such that rotational energy from said electrical motor is coupled to said rotor shaft.

6. The curling iron system of claim 3 wherein:

said holding mechanism is a holding cavity formed within said power base that is sized to frictionally engaged at least a portion of said handle when said handle is inserted therein.

7. The curling iron system of claim 3 wherein:

said electrical motor includes a curling iron engagement mechanism adapted for detachable connection with said drive motor engagement mechanism of said curling iron device; and said holding mechanism is a holding cavity formed within said power base that is sized to frictionally engaged at least a portion of said handle when said handle is inserted therein.

8. The curling iron system of claim 7 wherein:

said curling iron engagement mechanism is positioned within said holding cavity.

9. The curling iron system of claim 3, wherein:

said power base further includes a timer in controlling connection with said at least one electrical motor.

10. The curling iron system of claim 9 wherein:

said electrical motor includes a curling iron engagement mechanism adapted for detachable connection with said drive motor engagement mechanism of said curling iron device.

11. The curling iron system of claim 10 wherein:

said holding mechanism is a holding cavity formed within said power base that is sized to frictionally engaged at least a portion of said handle when said handle is inserted therein.

12. The curling iron system of claim 11 wherein:

said curling iron engagement mechanism is positioned within said holding cavity.

13. The curling iron system of claim 12, wherein:

said drive motor engagement mechanism is a first gear; and said curling iron engagement mechanism is a second gear that is meshable with said first gear in a manner such that rotational energy from said electrical motor is coupled to said rotor shaft.

14. The curling iron system of claim 1, further including:

a power base having a housing, at least one electrical motor, positioned within said housing, and a holding mechanism that is adapted to hold said curling iron device in a manner such that said tubular curling rod is prevented from rotating when said drive motor engagement mechanism is engaged with said electrical motor and said electrical motor is in operation.

15. The curling iron system of claim 14 wherein:

said electrical motor includes a curling iron engagement mechanism adapted for detachable connection with said drive motor engagement mechanism of said curling iron device.

16. The curling iron system of claim 15, wherein:

said drive motor engagement mechanism is a first gear; and said curling iron engagement mechanism is a second gear that is meshable with said first gear in a manner such that rotational energy from said electrical motor is coupled to said rotor shaft.

17. The curling iron system of claim 14 wherein:

said holding mechanism is a holding cavity formed within said power base that is sized to frictionally engaged at least a portion of said handle when said handle is inserted therein.

18. The curling iron system of claim 14 wherein:

said electrical motor includes a curling iron engagement mechanism adapted for detachable connection with said drive motor engagement mechanism of said curling iron device; and said holding mechanism is a holding cavity formed within said power base that is sized to frictionally engaged at least a portion of said handle when said handle is inserted therein.

19. The curling iron system of claim 18 wherein:

said curling iron engagement mechanism is positioned within said holding cavity.

20. The curling iron system of claim 14, wherein:

said power base further includes a timer in controlling connection with said at least one electrical motor.

* * * * *